US005083781A

United States Patent [19]

Alvarez

[11] Patent Number: 5,083,781

[45] Date of Patent: Jan. 28, 1992

[54] BOWLING PIN INSERTED BASE

[75] Inventor: Francisco J. Alvarez, Norton Shore, Mich.

[73] Assignee: Brunswick Corporation, Skokie, Ill.

[21] Appl. No.: 600,669

[22] Filed: Oct. 22, 1990

[51] Int. Cl.[5] ..... A63D 9/00

[52] U.S. Cl. ..... 273/82 B

[58] Field of Search ..... 273/82 R, 82 B

[56] References Cited

U.S. PATENT DOCUMENTS

| | | | |
|---|---|---|---|
| 2,180,676 | 11/1939 | Guimond | 273/82 |
| 2,517,116 | 8/1950 | Klinger | 273/82 |
| 2,738,977 | 7/1950 | Riley | 273/82 |
| 3,169,020 | 2/1965 | Smith | 273/82 |
| 3,186,713 | 6/1965 | Hebble | 273/82 |
| 3,232,616 | 2/1966 | Conklin et al. | 273/82 |
| 3,237,945 | 3/1966 | Isenberg et al. | 273/82 |
| 3,301,560 | 1/1967 | Satchell et al. | 273/82 |
| 3,346,258 | 10/1967 | Schimanski et al. | 273/82 |
| 3,455,113 | 5/1969 | Satchell et al. | 273/82 |
| 3,477,721 | 11/1969 | Satchell et al. | 273/82 |
| 3,525,524 | 8/1970 | Schmid | 273/82 |
| 3,971,837 | 7/1976 | Hasegawa et al. | 264/46.6 |
| 4,322,078 | 3/1982 | Mallette | 273/82 B |
| 4,630,820 | 12/1986 | Bertozzi | 273/82 |
| 4,865,320 | 9/1989 | Unterberger | 273/82 B |
| 4,971,322 | 11/1990 | Jager | 273/82 |

FOREIGN PATENT DOCUMENTS

| | | | |
|---|---|---|---|
| 0974717 | 9/1975 | Canada | 273/82 R |

*Primary Examiner*—Edward M. Coven
*Assistant Examiner*—William M. Pierce
*Attorney, Agent, or Firm*—Wood, Phillips, Mason, Recktenwald & Van Santen

[57] ABSTRACT

A bowling pin base ring or insert is locked to the outer plastic coating during the process of encapsulating the wooden pin core with an outer plastic covering. The base ring has a tapered annular surface defining a circumferential channel for engaging a portion of the exterior coating. A number of passages extend through the base ring such that gases produced in the coating process and air trapped in the mold are exhausted as heated coating material flows through the passage and bond the coating material to the base ring and to the wooden core.

8 Claims, 1 Drawing Sheet

Fig. 2
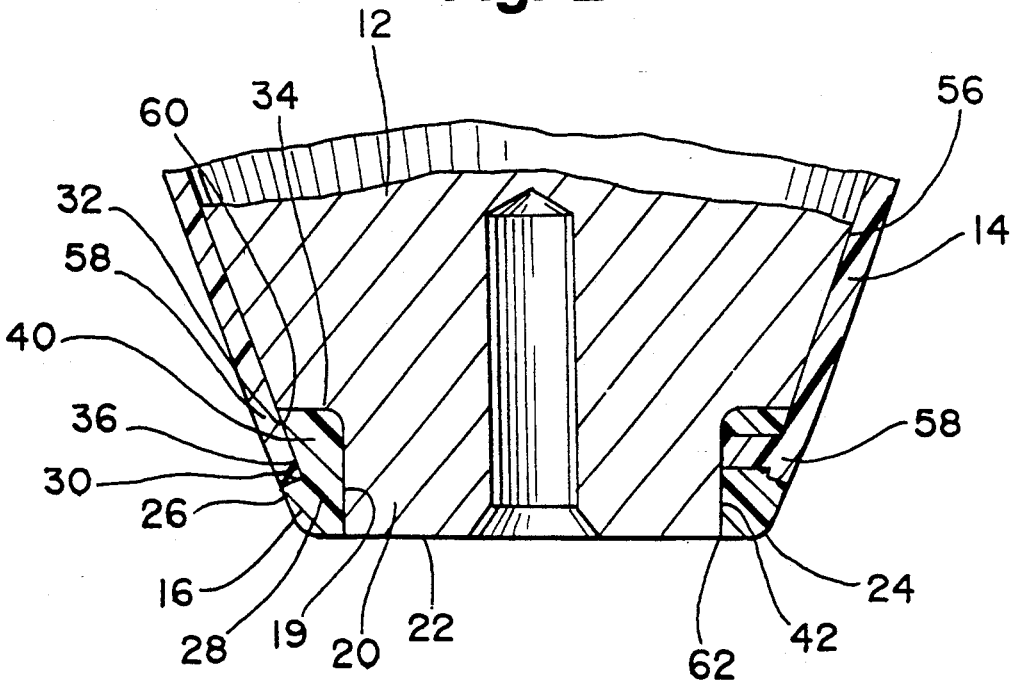
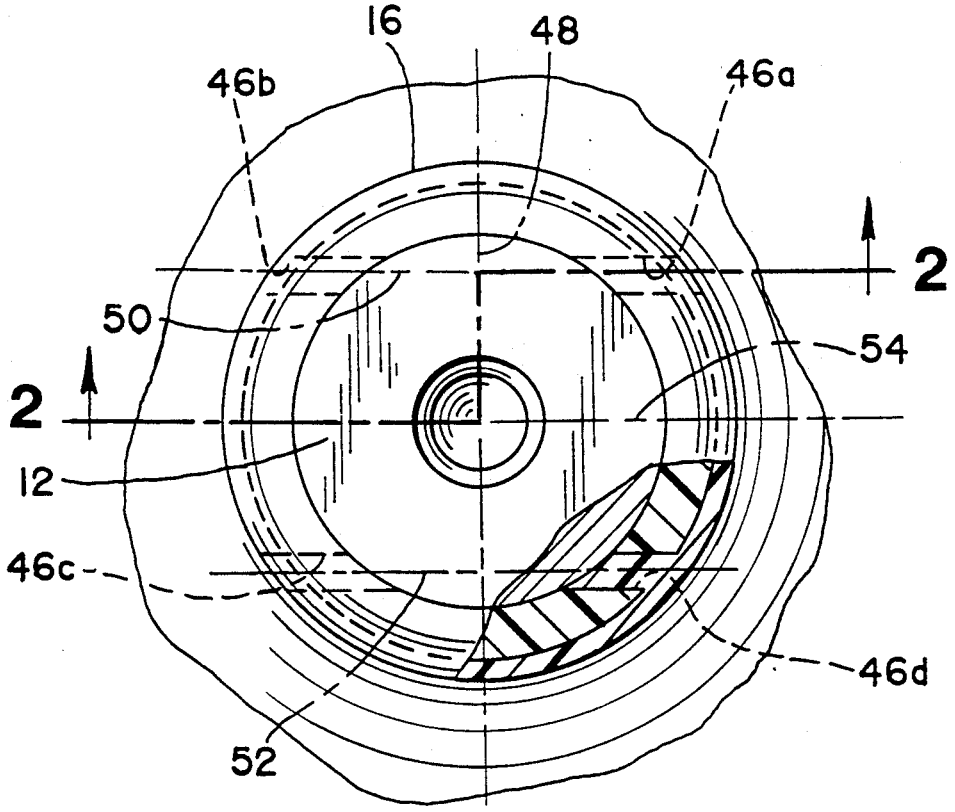
Fig. 1

BOWLING PIN INSERTED BASE

BACKGROUND OF THE INVENTION

1. Technical Field

The present invention is directed toward bowling pins, and specifically to an improved bowling pin base.

2. Background Art

Bowling pins typically have a wooden core, with a plastic coating for impact protection and durability. A bowling pin base insert is connected to the bottom of the wooden core and serves to reinforce the plastic cover. The bowling pin base is connected by forming an undercut in a groove in the wood and then heating one end of the insert to cause the plastic to flow into the undercut to bond the two parts together. This has the inherent disadvantage of being mechanically a cumbersome application and one which is difficult to monitor from a quality control point of view. Longevity of the pin is also a consideration as the use of two parts bonded together represents a point prone to later separation.

One proposed solution to this problem has been to bond or fuse the reinforcement base insert or ring into the encapsulating plastic cover instead of the wood. U.S. Pat. Nos. 4,332,078 to Mallette and 4,865,320 to Unterberger illustrate devices embodying this general concept. The base insert has a generally L-shaped perimeter seated into an undercut annular opening of the wooden core at the bottom of the pin prior to applying the plastic coating to the pin. The base insert is locked to the outer plastic coating or cover during the process of encapsulating the wooden pin with its outer plastic cover. During the covering process, the heated coating material flows into the undercut of the L-shaped perimeter of the base insert and forms a locking lip which bonds the base insert to the cover.

This type of base insert for interengaging the wooden core and the outer coating has inherent disadvantages. The base is held in place only by the molded plastic locking lips formed by the outer coating. In the high impact bowling environment, it is likely for the molded lips to fracture, resulting in the loosening of the base insert. Because of the geometry of the base, it is possible for the base to completely disengage the pin.

In the Unterberger U.S. Pat. No. 4,865,320, an expansion gap is provided between the base ring and the wood core and plural blind openings are formed in the bottom of the undercut groove. The covering material sometimes will and sometimes will not fill the blind openings so that the intended relative rotational anchoring between the cover and the base ring does not always occur so that the base ring breaks loose and starts the deterioration of the pin. The present invention is directed toward overcoming these problem.

SUMMARY OF THE INVENTION

In one aspect of the present invention, a bowling pin base ring or insert is provided which is locked to the outer plastic coating during the process of encapsulating the wooden pin core with an outer plastic covering. The base ring has a tapered annular surface defining a circumferential channel for engaging a portion of the exterior coating. A number of passages extend through the base ring such that gases produced in the coating process and air trapped in the mold are exhausted as heated coating material flows through the passage and bond the coating material to the base ring and to the wooden core.

BRIEF DESCRIPTION OF THE DRAWINGS

The invention will best be understood by reference to the following detailed description taken in connection with the accompanying drawings, in which:

FIG. 1 is a sectional view of the bowling pin base of the present invention taken along the lines 2—2 of FIG. 2; and FIG. 2 is an end view of the base ring shown in FIG. 1.

DESCRIPTION OF THE PREFERRED EMBODIMENT

The bottom portion of a bowling pin 10 is shown, in FIG. 1, having a wooden core 12 with an encapsulating exterior coating, or cladding, 14. A circular base ring, or insert, 16 has a cylindrical body member 18 engaging a cylindrical hub portion 20 of the wooden core 12. The hub 20 has a flat bottom surface 22 which, together with a bottom surface 24 of the base ring 16, defines a support platform upon which the bowling pin 10 rests.

Base ring 16 has an outwardly and upwardly tapered circumferential outer wall 26 defining a thickened upstanding lower portion 28 extending from the bottom surface 24, a first inwardly and upwardly tapered surface 30 extending radially inward from the outer wall 26, and a second outwardly and upwardly tapered surface 32 extending between the first inwardly tapered surface 30 and an upper end face 34 of the base ring 16. First tapered surface 30, together with second tapered surface 32, defines a beveled groove 36 which extends around the circumference of the base ring 16. Beveled groove 36 separates and defines the integral lower annular member or portion 28 and an upper annular member or portion 40 of the base ring 16. The lower annular portion 28 and upper annular portion 40 define the body member 18 having a common wall 19 with a diameter substantially mating with the outside diameter of the surface 42 of the hub portion 20 of the core 12. The upper annular portion 40 has a maximum upper diameter measured at the junction between the end face 34 and the tapered surface 32 and a lower minimum diameter measured at the apex of the beveled groove 36. Due to the taper of surface 32, the upper diameter is greater than the lower diameter.

The base ring 16 has a number of passages **46*a*, 46*b*, 46*c*, and 46*d* extending from the tapered surface 32 of upper annular member 28 through and to the wall 19 of the cylindrical inner sleeve 18 adjacent the hub 20. As shown in FIG. 2, passages 46*a–d* are circumferentially spaced about the hub 20. Passages 46*a* and 46*b* are symmetrically spaced on opposite sides of a diameter 48. Passages 46*c* and 46*d* are symmetrically spaced on opposite sides of the diameter 48. Passages 46*a*, 46*b* are colinear with a geometric cord 50 of the base 16, and passages 46*c*, 46*d* are colinear with a second geometric cord 52 of base ring 16. Geometric cords 50, 52 are parallel and symmetrically spaced about a diameter 54 of base ring 16. Although the openings 46*a–d*** are shown formed along cords, they could be formed radially or otherwise. There are manufacturing advantages to one direction of openings over another direction, but the structural advantages are substantially the same.

The manner in which the base ring 16 interlocks with the exterior cladding 14 and wooden core 12 will now be described. Prior to coating of the core, the base ring 16 is assembled on the hub 20 of the core 12. In this configuration, the base ring is movable both axially and radially on the hub. Heated coating material is then downwardly drawn over the outer surface 56 of the core 12. During the molding process, coating material will flow into the beveled groove 36 forming a locking collar 58 on the cladding 14. The complementary, inclined faces of the downwardly directed tapered surface 32 on the base ring 16 and the upwardly angled surface 60 on the locking collar 58 coact to interlock the base ring 16 and cladding such that the base ring is prevented from separating axially from the core 12.

As the heated coating is drawn downwardly over the core 12, gases produced in the coating process and air trapped in the mold are forced through the passages 46*a–d* and are exhausted through a narrow annular gap 62 extending between the inner sleeve 18 of the base 16 and the hub 20 of the core 12. In this way, the cladding 14 flows into and through all of the openings 46*a*, 46*b*, 46*c* and 46*d* and bonds with the core 12, providing a reinforced construction virtually eliminating the problem of later separation.

Still other aspects, objects, and advantages of the present invention can be obtained from a study of the specification, the drawings, and the appended claims.

I claim:

1. A base insert for supporting a bowling pin, comprising:

a cylindrical body member having an inside wall with a common and uniform inside diameter and extending axially between an upper end face and a lower end face to define a cylindrical interior space within said body member, said body member having an outside wall with a tapered outside diameter defined by an upper annular portion adjacent said upper end face and a lower annular portion adjacent said lower end face, said upper annular portion having a tapered surface on its outside diameter such that the diameter decreases as the surface progresses in a direction from the upper end to the lower end, said lower annular portion having a tapered surface on its outside diameter such that the diameter decreases as the surface progresses in a direction from the lower end to the upper end; and at least one opening extending from at least one of said two tapered surfaces through said cylindrical body member and communicating with said interior space.

2. The base insert as claimed in claim 1 wherein plural openings extend through said cylindrical body member and terminate at said inside wall.

3. The base insert as claimed in claim 1 wherein said opening extends from said tapered surface of said upper annular portion.

4. The base inert as claimed in claim 3 wherein plural openings extend from said upper annular portion through and to said inside wall.

5. In a bowling pin having a shaped central core with a reduced diameter lower hub, a base insert encircling said reduced diameter lower hub, and an exterior plastic cladding encircling said core and part of said base insert, the improvement comprising:

said base insert having a cylindrical body divided into a lower annular portion having a lower end face and an upper annular portion having an upper end face, said insert defining an interior space extending axially between said upper end face and said lower end face and cooperating with said lower hub to support the bowling pin on a generally horizontal surface;

a tapered outer surface on said lower annular portion having a diameter which decreases as the surface progresses in a direction from the lower end to the upper end of said tapered outer surface;

a tapered outer surface on said upper annular portion having a diameter which increases as the surface progresses in a direction from the lower end to the upper end of said last named tapered outer surface, said two tapered surfaces joining and defining an annular groove which divides the upper annular portion from the lower annular portion;

at least one opening extending from at least one of said tapered outer surfaces, through the cylindrical body and communicating with said interior space; and said cladding nesting in said annular groove, in said at least one opening, and filling any open spaces between the base insert and the hub of the core.

6. The bowling pin of claim 5 wherein said at least one opening opens through said tapered surface of the upper annular portion.

7. The bowling pin of claim 6 wherein a plurality of circumferentially, equally spaced openings extend from said tapered surface and wherein said cladding material fills said plurality of openings.

8. The bowling pin of claim 5 wherein said upper annular portion has a larger diameter at the upper end face of the base insert than at the junction of said two tapered surfaces whereby the base insert will be retained against axial fallout and whereby the cladding in the openings will retain the base insert against relative rotation with respect to the cladding and to the core.

* * * * *